United States Patent [19]

Dziki

[11] Patent Number: 4,658,991

[45] Date of Patent: Apr. 21, 1987

[54] HAND PRESSURE ATTACHMENT FOR USE ON THERMOPLASTIC DISPENSING DEVICE

[75] Inventor: Michael M. Dziki, St. Paul, Minn.

[73] Assignee: Minnesota Mining and Manufacturing Company, Saint Paul, Minn.

[21] Appl. No.: 698,812

[22] Filed: Feb. 6, 1985

Related U.S. Application Data

[63] Continuation-in-part of Ser. No. 664,044, Oct. 23, 1984, which is a continuation-in-part of Ser. No. 456,346, Jan. 7, 1983, Pat. No. 4,552,287.

[51] Int. Cl.[4] ..... B67D 5/62

[52] U.S. Cl. ..... 222/146.5; 222/391; 222/409; 74/141.5; 226/127

[58] Field of Search ..... 222/146.5, 174, 323, 222/324, 391, 402.15, 409; 239/83, 84, 526, 532; 219/230; 226/127–133; 74/128, 141.5, 169

[56] References Cited

U.S. PATENT DOCUMENTS

| | | | |
|---|---|---|---|
| 872,482 | 12/1907 | Tolman | 222/324 X |
| 1,837,198 | 12/1931 | Boylan | 222/474 X |
| 2,556,609 | 6/1951 | Arkless | 222/324 X |
| 3,229,859 | 1/1966 | Conroy et al. | 222/174 |
| 3,612,357 | 10/1971 | Ruskin | 222/146 |

*Primary Examiner*—H. Grant Skaggs
*Assistant Examiner*—Frederick R. Handren
*Attorney, Agent, or Firm*—Donald M. Sell; James A. Smith; William L. Huebsch

[57] ABSTRACT

An attachment adapted for use on a device for melting and dispensing thermoplastic material having a thumb operated drive assembly for driving a block of thermoplastic material into the device. The attachment comprises a lever having an upper end adapted for engagement with the drive assembly and a lower end pivotably attached to a collar adapted to be releasably attached to a handgrip of the device. With the attachment in place, a user can squeeze the lever toward the handle with his hand to dispense the thermoplastic material.

1 Claim, 16 Drawing Figures

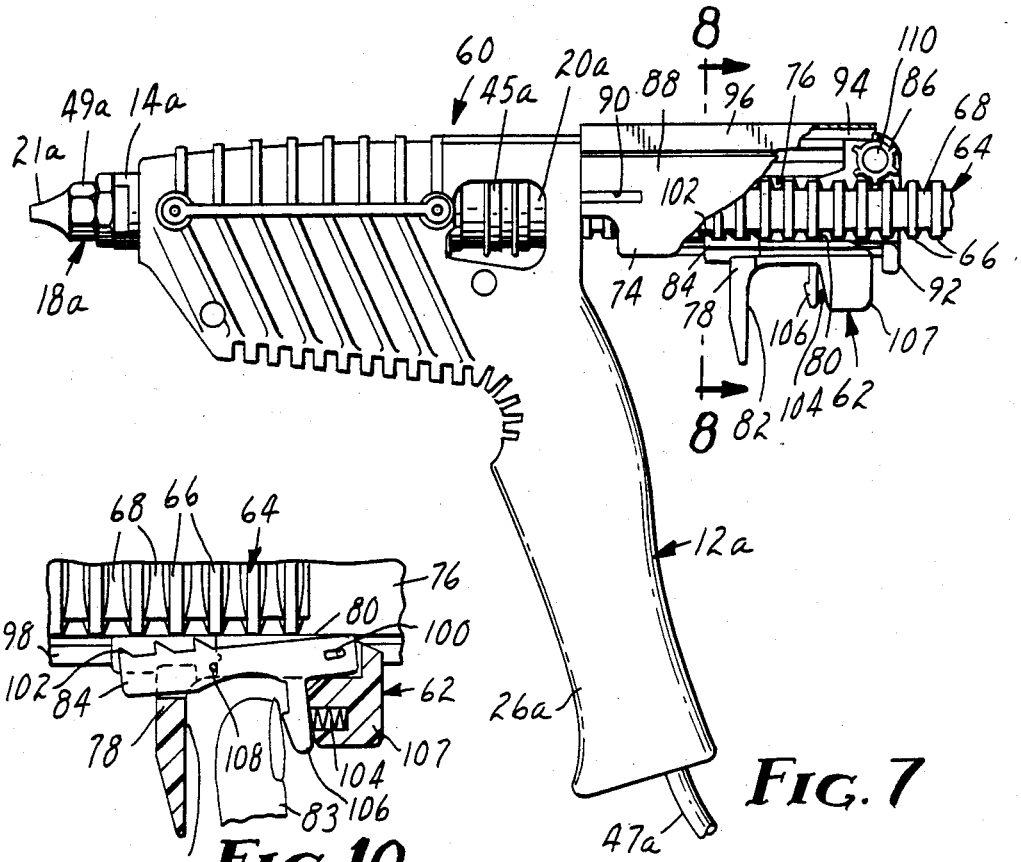
FIG. 7
FIG. 10
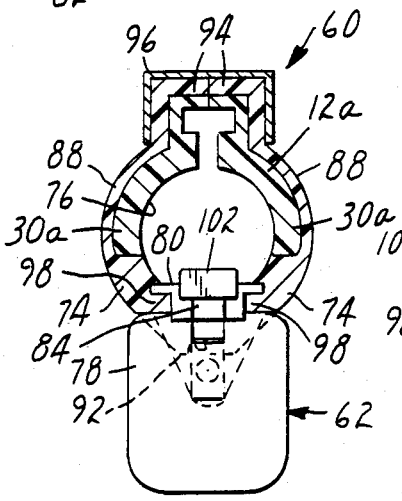
FIG. 8
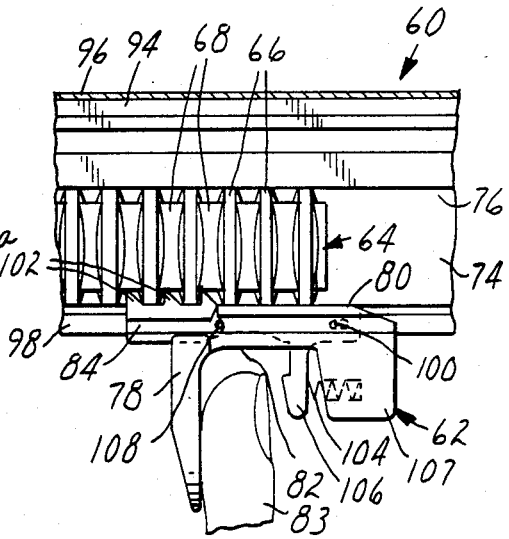
FIG. 9

HAND PRESSURE ATTACHMENT FOR USE ON THERMOPLASTIC DISPENSING DEVICE

CROSS REFERENCE TO RELATED APPLICATION

This application is a continuation in part of U.S. patent application No. 664,044 filed Oct. 23, 1984, which is in turn a continuation in part of U.S. patent application No. 456,346 filed Jan. 7, 1983, now U.S. Pat. No. 4,552,287.

TECHNICAL FIELD

This application relates to devices for dispensing molten thermoplastic materials into which blocks of solid thermoplastic material are manually pressed.

BACKGROUND OF THE INVENTION

Many devices are known for dispensing molten thermoplastic materials from blocks of solid thermoplastic material manually pressed into the device.

Generally, such devices comprise a barrel member having an internal melting chamber which communicates with an outlet opening through a nozzle, and a sleeve with a through opening having one end secured to the barrel member with its through opening communicating with the end of the melting chamber opposite the nozzle. The sleeve is adapted to receive an elongate cylindrical block of solid thermoplastic material which fits closely within the through opening in the sleeve, with one end portion of the block in the melting chamber and the other end portion projecting through the sleeve. Means are provided for heating the barrel member to melt the end portion of the block therein, and the device includes a handle positioned so that an operator can grip the handle with the fingers of one hand while manually pressing the block through the sleeve and into the melting chamber to force molten thermoplastic material out of the melting chamber through the nozzle.

Two such devices for dispensing molten thermoplastic material described in my U.S. patent application No. 664,044 filed Oct. 23, 1984, of which this application is a continuation-in-part, provide, among other things, a feeding mechanism at the end of the sleeve opposite the melting chamber comprising wall means fixed to the frame and defining a passageway adapted to guide the solid thermoplastic material block in alignment with the trough opening in the sleeve, a slide having pressure surfaces adapted to receive the end portion of an operator's thumb, and being mounted on the frame for movement along a path generally aligned with the melting chamber from a retracted position spaced from the sleeve to an advanced position more closely adjacent the sleeve and back to the retracted position, the pressure surfaces being accessible by the thumb of an operator gripping the handle portion to afford manual reciprocation of the slide between the retracted and advanced positions by the operator, and the slide being adapted for engaging and advancing the block of thermoplastic material toward the melting chamber during movement of the slide from its retracted to its advanced position.

DISCLOSURE OF THE INVENTION

The present invention provides an attachment that may be used on a dispenser of the type described above to afford applying pressure with the palm of a users hand instead of his thumb which may be preferable for some users of the dispenser.

According to the present invention there is provided an attachment for use on a device for dispensing molten thermoplastic material of the type comprising a frame including a handle positioned so that an operator can grip the handle with the fingers of one hand, a barrel member mounted on the frame and having an internal melting chamber communicating with an outlet opening through a nozzle, a sleeve with a through opening having one end secured to the barrel member with the through opening communicating with the end of the melting chamber opposite said outlet opening, the sleeve being adapted to receive the block of solid thermoplastic material with one end portion of the block in the melting chamber and the block projecting through the sleeve, means for heating the barrel member to melt the end portion of the block therein, a feeding mechanism at the end of the sleeve opposite the melting chamber defining a passageway adapted to guide a solid thermoplastic material block in alignment with the through opening in the sleeve; and a slide having a pressure surface adapted to receive the end portion of an operator's thumb, and being mounted on the frame for movement along a path generally aligned with the melting chamber from a retracted position spaced from the sleeve to an advanced position more closely adjacent the sleeve and back to its retracted position. The attachment comprises a collar adapted for releasable engagement around a distal end portion of the handle, a lever having a lower end pivotably mounted on the collar and an upper end portion adapted for engagement with the pressure surface when the collar is engaged with the handle, and means for biasing the lever to bias the slide toward its retracted position.

BRIEF DESCRIPTION OF THE DRAWING

The present invention will be further described with reference to the accompanying drawing wherein like reference numerals refer to like parts in the several views, and wherein:

FIG. 7 is a side view of a dispensing device which is similar to the device of FIG. 1 except that it includes a different manually operable feeding mechanism for feeding blocks of solid thermoplastic material of the type shown in FIG. 6;

FIG. 8 is an enlarged sectional view taken approximately along line 8—8 of FIG. 7;

FIG. 9 is an enlarged fragmentary view of a slide and drive means in the dispensing device of FIG. 7 being used to press a block of solid thermoplastic material into the device;

FIG. 10 is an enlarged fragmentary view of the slide and drive means shown in FIG. 9 being retracted along a block of solid thermoplastic material in the device;

THE DESCRIPTION OF THE PREFERRED EMBODIMENT

Figure 1:
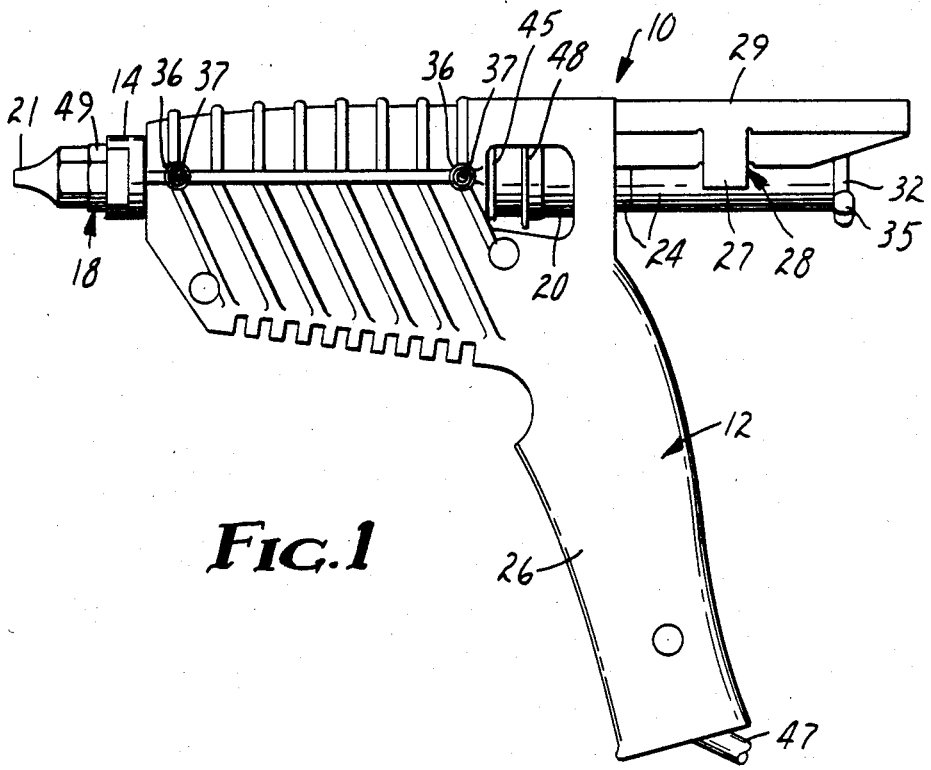
FIG. 1 is a side view of a first embodiment of a dispensing device described in my U.S. patent application No. 664,044.
Figure 2:
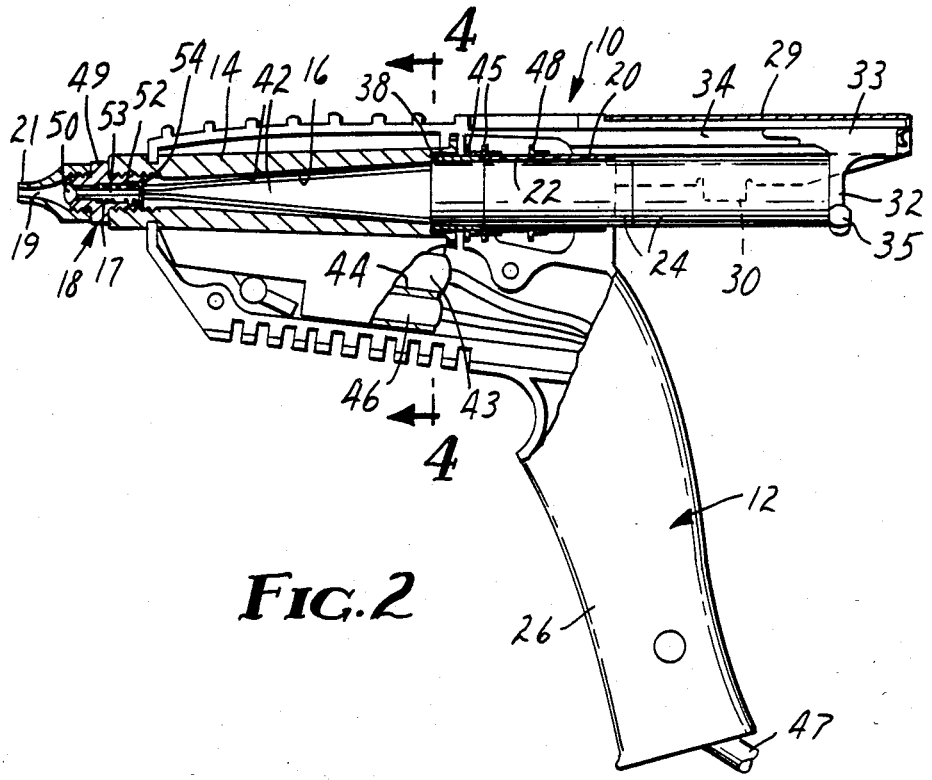
FIG. 2 is a side view of the dispensing device of FIG. 1 having parts broken away to show details.
Figure 4:
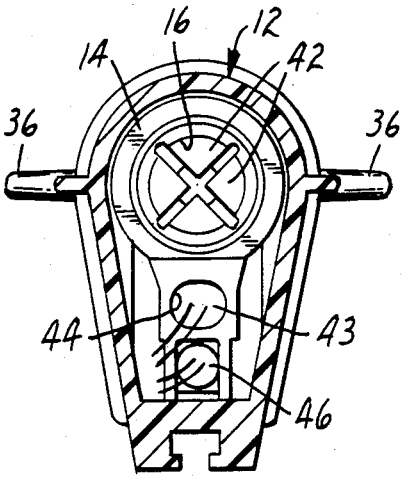
FIG. 4 is an enlarged sectional view taken approximately along lines 4—4 of FIG. 2.
Figure 5:
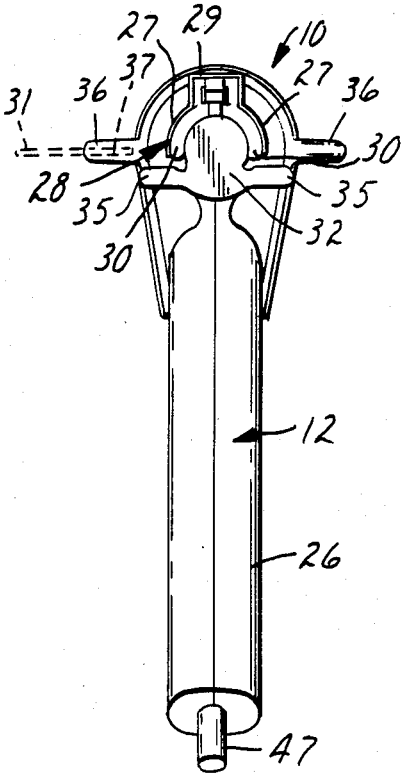
FIG. 5 is an end view of the dispensing device of FIG. 1.
Figure 3:
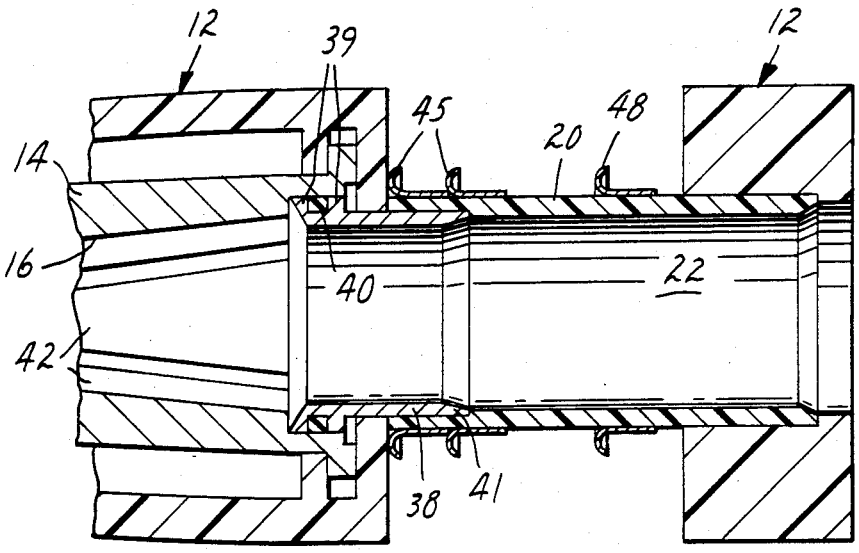
FIG. 3 is an enlarged fragmentary sectional view of a barrel member, a sleeve, and a barrier ring therebetween in the dispensing device of FIG. 1.

Referring now to the drawing there is shown in FIGS. 1 through 5 a dispensing device for molten thermoplastic material generally designated by the reference numeral 10, which device 10 was described in my U.S. patent application No. 644,044 filed Oct. 23, 1984 and in my U.S. Pat. No. 4,552,287, issued Nov. 12, 1985.

Like known prior art dispensing devices for thermoplastic material, the dispensing device 10 comprises a two part frame 12, a barrel member 14 mounted between the parts of the frame 12 and having an internal melting chamber 16 communicating via a discharge passageway 17 through a valve assembly 18 with an outlet opening 19 through a nozzle 21, and a sleeve 20 with a cylindrical through opening 22 having one end secured to the barrel member 14 with its through opening 22 communicating with the end of the melting chamber 16 opposite the discharge passageway 17. The sleeve 20 is adapted to receive a cylindrical block 24 of solid thermoplastic material within the cylindrical through opening 22 with a slight clearance fit even when the diameter of the block 24 is at the large end of its tolerance range, with one end portion of the block 24 in the melting chamber 16 and the block 24 projecting through the opening 22 in the sleeve 20. Means are provided in the device 10 for heating the barrel member 14 to melt the end portion of the block 24 therein. The frame 12 includes a handle 26 positioned so that an operator can grip the handle 26 with the fingers of one hand while applying pressure with the thumb of that hand to press the block 24 through the sleeve 20 and into the melting chamber 16 and force molten thermoplastic material out of the melting chamber 16 through the valve assembly 18 and nozzle 21.

Unlike known prior art devices, the device 10 further includes a bracket assembly 28 at the end of the sleeve 20 opposite the barrel member 14, which bracket assembly 28 includes means adapted for receiving and for holding a second block 24 of solid thermoplastic material in aligned end-to-end relationship with the block 24 of thermoplastic material in the sleeve 20 while affording the application of force by the thumb of an operator on the end of the block 24 opposite the sleeve 20 to press the second block 24 through the sleeve 20 and into the melting chamber 16.

As illustrated, the bracket assembly 28 comprises spaced opposed gripping parts 30 of the frame 12 (FIG. 5) that project toward the handle 26.in a position spaced from the outer end of the sleeve 20 and on opposite sides of an extension of the axis for the sleeve 20. The gripping parts 30 are biased toward each other by spring means comprising a channel-like member 29 of spring steel engaged around the top surfaces of the two parts of the frame 12 to help hold the two parts of the frame 12 together, and having opposed arcuate projecting portions 27 that are biased against the outer surfaces on the gripping parts 30 of the frame 12. The gripping parts 30 have distal ends spaced at a distance that is less than the diameter of the cylindrical block 24 of thermoplastic material, but which distance is sufficient so that the block 24 can be transversely pressed therebetween to resiliently move the gripping parts 30 away from each other in opposition to the biasing of the projecting portions 27 and afford movement of the block 24 therebetween. Also, the gripping parts 30 have concave opposed inner surfaces adapted to conform to and engage the cylindrical side surfaces of a block 24 of thermoplastic material therebetween to hold the block 24 in alignment with a block 24 in the sleeve 20, while affording axial sliding movement of the block 24 and movement of the thumb of the operator between the gripping parts 30 to move the second block 24 into the sleeve 20.

The device also comprises a pressure plate 32 adapted to abut the end of the outermost block 24 of thermoplastic material opposite the melting chamber 16 and to be positioned between the block 24 and the user's thumb to transfer force therebetween. The plate 32 includes an elongate slide portion 33 (FIG. 2) at one edge slidably mounted in a track 34 defined between the parts of the frame 12 to afford movement of the plate 32 with the block 24 and is shaped to pass between the gripping parts 30 so that the plate 32 can be used to push the block 24 fully into the sleeve 20 while directing forces applied to the plate 32 in the longitudinal direction of the block 24, and protects an operator's thumb from contact with the thermoplastic block 24 and from contact with any molten thermoplastic material that (under unusual conditions) might extrude to the outer end of the sleeve 20. The pressure plate 32 includes two wing portions 35, one projecting from each side, which wing portions 35 are positioned to pass under the gripping parts 30 as the pressure plate 32 is used to press the block 24 into the sleeve 20, and either of which wing portions 35 can be manually engaged to move the pressure plate 32 away from the sleeve 20 to facilitate placing a new block 24 of thermoplastic material between the gripping parts 30 after a previous block 24 has been pushed into the sleeve 20.

The two parts of the frame 12 are molded of a suitable high temperature resistant polymeric material (e.g., the material commercially designated Dupon, Zytel FR50-NC10 available from E. I. DuPont deNemours, Wilmington, Del.). Both parts of the frame 12 are formed with spaced posts 36 projecting generally radially outwardly of the barrel member 14, which posts 36 can provide means for spacing the major side surface of the frame 12 and the nozzle 21 of the device 10 from a horizontal surface on which the device 10 is laid, and which posts 36 have sockets 37 adapted to receive end portions of a generally U-shaped wire 31 (FIG. 5) to further space the device 10 away from such a surface should that be desired.

The sleeve 20 is made of a stiff heat-resistive polymeric material (e.g., Teflon®) made by an extrusion process to provide a polished inner surface with microscopic longitudinally extending scratches that facilitates movement of the thermoplastic material through the sleeve 20, particularly after molten thermoplastic has cooled in the sleeve 20 and is again heated by the device 10.

The sleeve 20 is coupled to the barrel member 14 by a metal barrier ring 38 (FIGS. 2 and 3) that is heated by the means for heating the barrel member 14, which barrier ring 38 provides means for restricting the extrusion of molten thermoplastic material between the block 24 and the inner surface of the sleeve 20. The inlet barrier ring 38 is a generally cylindrical member having axially spaced radically outwardly projecting ribs 39 at one end positioned in a cylindrical socket in the end of the barrel member 14, between which ribs 39 is a sealing strip 40 pressed between the barrier ring 38 and barrel member 14 to provide a seal therebetween. An end portion 41 of the barrier ring 38 opposite the barrel member 14 is press fit into an internally relieved area of the sleeve 20. The barrier ring 38 has a cylindrical inside surface that is smaller in diameter than the inside diameter of the sleeve 20 (which sleeve 20 is adapted to always receive a block 24 with a slight clearance fit even when the diameter of the block 24 is at the upper end of its tolerance limits) so that the barrier ring 38 will receive a block 24 having a diameter at the upper end of its tolerance limits with a slight interference fit (e.g., an interference of up to 0.025 cm) or will receive a block 24 having a diameter at the lower end of its tolerance range with a clearance fit of about 0.050 cm. Surprisingly those blocks 24 with a diameter that provides such a slight interference fit with the barrier ring 38 will be melted sufficiently around their periphery by the heated barrier ring 38 that they can be easily pressed into the melting chamber 16, and blocks 24 of thermoplastic material with diameters that provide either such slight interference fits or clearance fits fit sufficiently close in the barrier ring 38 so that no significant amount of molten polymeric material will extrude out of the melting chamber 16 between the block 24 and the barrier ring 38 and toward the outer end of the sleeve 20 between the block 24 and the sleeve 20.

The device 10 also includes three metal (preferably brass) cooling flanges around the outer periphery of the sleeve 20 that provide means for developing predetermined temperature zones in the sleeve 20, including two closely spaced regulating flanges 45 at the end of the sleeve 20 adjacent the barrier ring 38 which cool and regulate the temperature of the molten thermoplastic material in the area between the barrier ring 38 and the sleeve 20, and a cooling flange 48 about centered along the length of the sleeve 20 that cools the sleeve 20 to restrict the thermoplastic material from becoming molten past that area along the sleeve 20, even if the heating means is activated for a long period of time during which molten thermoplastic material is not being dispensed from the device 10.

The barrel member 14 is of a suitable metal (e.g. aluminum). The melting chamber 16 in the barrel 14 is defined by a generally frustoconical inner surface tapered toward the valve assembly 18 to direct the molten polymeric material to the discharge passageway 17 through the valve assembly 18, and four equally spaced radially inwardly projecting ribs 42 which provide heated contact surfaces in addition to the frustoconical inner surface for engaging and melting the blocks 24 of thermoplastic material as they are pressed into the chamber 16. An electric heating element 43 which heats both the barrel member 14 and the barrier ring 38 is positioned in a socket 44 in the barrel member 14 beneath the chamber 16, and a thermostat 46 is fixed in a channel below the heating element 43 to disconnect electrical power normally supplied the heating element 43 via a power cord 47 and the thermostat 46 when the temperature of the barrel member 14 at the thermostat 46 exceeds a predetermined maximum (e.g., 200° C.).

The valve assembly 18 between the barrel member 14 and the nozzle 21 provides valve means for restricting molten thermoplastic material from running out of the nozzle 21 until a predetermined amount of force (e.g., about 0.9 to 1.8 kilograms) is manually applied to the block 24 of thermoplastic material to cause pressure in the molten thermoplastic material in the melting chamber 16. The valve assembly 18 is of the poppet valve type and includes a valve body 49 secured between the barrel member 14 and nozzle 21, which valve body 49 defines the discharge passageway 17 communicating between the melting chamber 16 and the opening 19 through the nozzle 21. The discharge passageway 17 through the valve body 49 is normally closed by a head 50 on a valve normally biased against a valve seat on the end of the valve body 49 adjacent the nozzle 21 by a spring 52 compressed between a flange on the valve body 49 and a perforated retaining disk 54 fixed on a stem 53 of the valve, which disk 54 is axially slidably mounted in the valve body 49. Pressure from molten thermoplastic material in the melting chamber 16 and discharge passageway 17 caused by pressure manually applied to the block 24 of thermoplastic material can move the valve head 50 away from its seat against the bias of the spring 52 and allow molten thermoplastic material to pass the valve head 50 and be discharged through the nozzle 21. When the operator releases such pressure, however, the valve head 50 will again move to its seat under the influence of the spring 52 to prevent any more molten thermoplastic material within the melting chamber 16 and discharge passageway 17 from escaping through the nozzle 21.

To use the dispensing device 10, an operator first connects the power cord 47 to a source of electrical power so that the barrel member 14 and barrier ring 38 are heated by the heating element 43. The operator then places the block 24 of thermoplastic material in the opening 22 through the sleeve 20, grabs the handles 26 with one hand, and uses the thumb of that hand to press against the pressure plate 32 to slide it along the track 34 into engagement with the block 24 and thereby press the block 24 through the sleeve 20 and barrier ring 38 and into the melting chamber 16 in the barrel member 14 where the end portion of the block 24 will be made molten by contact with the inner surface of the barrel member 14, including the inwardly projecting ribs 42. While the inner surface of the sleeve 20 will provide a clearance fit with the periphery of the block 24, even if the diameter of the block 24 is at the upper limit of its tolerance range, the barrier ring 38 has a cylindrical inner surface with a slightly smaller inner diameter than the inner diameter of the sleeve 20 and will provide a slight interference fit or a very close clearance fit with the block 24, depending on whether the diameter of the block 24 is at the upper or lower limit of its tolerance range. If there is an interference fit, the barrier ring 38 will melt the periphery of the thermoplastic block 24 sufficiently to allow it to easily pass; and in either event the barrier ring 38 will greatly restrict extrusion of thermoplastic material from the melting chamber 16 back between the block 24 and the barrier ring 38 and thus between the block 24 and the inner surface of the sleeve 20. Sufficient pressure in the molten thermoplastic within the melting chamber 16 caused by manual pressure on the pressure plate 32 and block 24 will cause the head 50 of the valve to move away from its valve seat against the bias of the spring 52 so that the molten thermoplastic can flow around the head 50 and out the outlet opening 19 of the nozzle 21. When manual pressure is released on the pressure plate 32, the head 50 will again move to its seat under the influence of the spring 52 which stops the flow of molten material through the nozzle 21 and restricts air from reaching the molten thermoplastic material in the melting chamber 16, thereby restricting oxidation of the molten thermoplastic in the valve assembly 18. If the heating element 43 remains activated for a long time while no molten thermoplastic material is dispensed through the nozzle 21, heat buildup can cause the block 24 to melt (at least around its periphery), to about the midpoint of the sleeve 20 where such melting will be restricted by the cooling effect of the cooling flange 48. If the power is then disconnected so that this molten thermoplastic material cools and solidifies, and the power is then again connected to heat the heating element 43, the thermoplastic material in the valve assembly 18 will be some of the first thermoplastic material melted and the valve assembly 18 can act as a relief valve for pressure developed in the barrel member 14 as the rest of the thermoplastic material in the barrel member 14 melts. Also, the smooth longitudinally microgrooved inner surface of the sleeve 20 will facilitate breaking loose of the block 24 from the sleeve 20 to press it through the barrier ring 38 and into the melting chamber 16 to again cause the molten thermoplastic material to flow out of the nozzle 21.

When the outer end of the block 24 of thermoplastic material reaches the outer end of the sleeve 20, the operator can manually retract the pressure plate 32 along its track 34 via one of the wing portions 35 and press a new block 24 of thermoplastic material transversely between the gripping parts 30 of the holding bracket 28, whereupon the new block 24 will be held in proper alignment with the sleeve 20, and the operator can again use the pressure plate 32 to press the new block 24 into the melting chamber 16.

Figure 6:
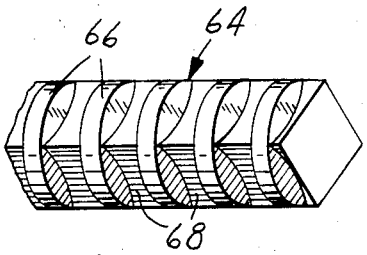
FIG. 6 is a perspective view of a block of solid thermoplastic material.

Referring now to FIGS. 7 through 10 of the drawing there is shown a dispensing device 60 for molten thermoplastic material that was described in my U.S. patent application No. 644,044 filed Oct. 23, 1984. The device 60 has the same structure as the device 10 except that the channel 29 and pressure plate 32 of the device 10 have been replaced by a manually operated feeding assembly 62, which assembly 62 is adapted to feed a block 64 of solid thermoplastic material having the shape best illustrated in FIG. 6. Parts of the device 60 that have the same structures as parts of the device 10 have been given the same reference numerals to which have been added the suffix "a".

The block 64 of solid thermoplastic material (FIG. 6) comprises a plurality of coaxial generally cylindrical portions 66 with uniform predetermined axial and diametrical dimensions (e.g., about 0.38 centimeter and 1.5 centimeter respectively), which generally cylindrical portions 66 are uniformly axially spaced along the block 64 by similarly sized and oriented portions 68 having rectangular cross sections (preferably square as illustrated) having uniform diagonal dimensions about equal to the diametrical dimensions of the cylindrical portions 66, having corners aligned with the peripheries of the cylindrical portion 66 and having axial dimensions that are substantially less than those of the cylindrical portion 66 (e.g., about 0.25 centimeter). These alternating cylindrical and rectangular portions 66 and 68 result in a block 64 with evenly spaced projecting arcuate parts of the cylindrical portions 66 projecting from each of four sides of the block 64 defined by the aligned peripheral surfaces of the rectangular portions 68. These projecting arcuate parts provide uniformly spaced opposed arcuate teeth along opposite sides of the block 64 with planar slug surface portion between roots of adjacent teeth, and these teeth or projecting parts of the cylindrical portion 66 are like teeth on a rack and allow the block 64 to be aligned and driven by the feeding assembly 62, as will be further explained below. The spaces between these projecting parts of the cylindrical portions 66 also provide receptacles for molten material to facilitate melting the block 64 within the device 60 as has previously been described.

Like the dispensing device 10, the device 60 comprises a two part frame **12*a*, a barrel member 14*a* mounted between the parts of the frame 12*a* and having an internal melting chamber communicating via a discharge passageway through a valve assembly 18*a* with an outlet opening through a nozzle 21*a*, and a sleeve 20*a* with a cylindrical through opening having one end secured to the barrel member 14*a* with its through opening communicating with the end of the melting chamber opposite the discharge passageway. The sleeve 20*a* is adapted to receive the block 64 of solid thermoplastic material within the cylindrical through opening with a slight clearance fit even when the diameter of the block 64 is at the large end of its tolerance range, with one end portion of the block 64 in the melting chamber and the block 64 projecting through the opening in the sleeve 20*a*. Means are provided in the device 60 for heating the barrel member to melt the end portion of the block 64 therein. The frame 12*a* includes a handle 26*a* positioned so that an operator can grip the handle 26*a* with the fingers of one hand while applying pressure with the thumb of that hand to press the block 64 through the sleeve 20*a* and into the melting chamber to force molten thermoplastic material out of the melting chamber through the valve assembly 18*a* and nozzle 21*a***.

Unlike the device 10, the device 60 includes the feeding assembly 62 at the end of the sleeve **20*a* opposite the barrel member 14*a*, which feeding assembly 62 includes means adapted for receiving and for holding the block 64 of solid thermoplastic material in the sleeve 20*a*, while affording the application of force by the thumb of an operator on the block 64 to press it into the sleeve 20*a*** toward the melting chamber.

As illustrated, the feeding assembly 62 comprises (1) wall means or walls 74 removably fixed to the frame **12*a*, that define a passageway 76 adapted to guide the solid thermoplastic material block 64 in alignment with the through opening in the sleeve 20*a*; (2) a slide 78 having a cylindrically- concave upper surface 80 adapted to support the block 64, having projecting parts defining a recess 82 opening through its side opposite its upper surface 80 adapted to receive the end portion of an operator's thumb 83, and being mounted on the walls 74 for movement along a path generally aligned with the melting chamber from a retracted position spaced from the sleeve 20***a* to an advanced position more closely adjacent the sleeve 20*a* and back to its retracted position, the recess 82 being accessible by the thumb 83 of an operator gripping the handle 26*a* to afford manual reciprocation of the slide 78 between its retracted and advanced positions by the operator; (3) drive means comprising a drive member 84 pivotably mounted on the slide 78 adapted for engaging the cylindrical portions 66 of the block 64 of thermoplastic material and advancing the block 64 toward the melting chamber during movement of the slide 78 from its retracted to its advanced position, and for moving around the cylindrical portions 66 and along the block 64 of thermoplastic during movement of the slide 78 from its advanced to its retracted position; and (4) means comprising a sprocket wheel 86 rotatably mounted on the walls 74 for aligning the block 64 of thermoplastic in the passageway 76 for engagement by the drive member 84 and for providing friction to help retain the block 64 in the passageway 76 before it is engaged by the drive means.

The walls 74 that define the passageway 76 for receiving the block 64 in a position aligned with the through opening in the sleeve 20*a* each have generally arcuate opposed portions 88 (FIG. 8) relieved along their inner surfaces to receive the gripping parts 30*a* and the surrounding supporting structure of the frame 12*a*, and having through slots 90 (FIG. 7) at their ends adjacent the sleeve 20*a* that receive normally horizontal reinforcing webs on the frame 12*a*. The walls also include transverse end wall portions 92 (FIG. 7) at their ends opposite the sleeve 20*a* that interlock at their bottom edge, and longitudinally extending opposed contacting top wall portions 94 that are held together by a U-shaped spring metal channel 96 that fits around the top wall 94 portions to hold the walls 74 in place around the gripping parts 30*a* and adjacent portions of the frame 12*a*. The arcuate portions 88 of the walls 74 have inner surfaces that, with the inner surfaces of the gripping parts 30*a*, define the passageway 76 that has an inlet through the end wall portions 92.

The walls 74 also include opposed longitudinally extending spaced ledges 98 along their edges opposite the top wall portions 94, and the slide 78 has opposite longitudinally extending grooves to receive the ledges 98 to afford reciprocation of the slide 78 along the ledges 98 between its retracted and advanced positions.

The drive member 84 is elongate, has a plurality of or three teeth 102 adapted to engage between the cylindrical portions 66 of the block 64 projecting from one side adjacent a first end and is positioned in a groove in the slide 78 extending axially of the passageway 76 with its longitudinal direction generally parallel to the passageway 76 and the teeth 102 adjacent the sleeve 20*a*. The drive member 84 has its second end opposite its first end mounted on the slide 78 by a pivot pin 100 extending transverse to the passageway 76 for pivotal movement between (1) an engage position (FIG. 9) with the teeth 102 in engagement between the cylindrical portions 66 of a block 64 positioned in the passageway 76 (to which engage position the drive member 84 is biased by a coil spring 104 between projections 106 and 107 projecting respectively from the sides of the drive member 84 and slide 78 opposite the passageway 76): and (2) a release position (FIG. 10) with the teeth 102 spaced from the block 64 in the passageway 76 (toward which release position the drive member 84 can be pivoted by camming movement of the inclined rear surface of the teeth 102 over the cylindrical portions 66 of the block 64 and/or engagement of an operator's thumb with the projection 106 to move the slide 78 toward its retracted position).

Additionally means are provided for restricting pivotal movement of the drive member 84 from its engage to its release position when an operator applies force to the slide 78 to move it towards its advanced position. The opening through the drive member 84 in which the pivot pin 100 is received is elongate in a direction parallel to the passageway 76 so that, in its engage position, the drive member 84 can move axially of the passageway 76 and longitudinally with respect to the slide 78 on which it is mounted between (1) a normal position to which it is biased by the spring 104 and from which it can be pivoted to its release position due to separation between a lock pin 108 through the drive member 84 and the slide 78 (FIG. 10), and (2) a locked position (FIG. 9) with the lock pin 108 engaged in a transverse groove along a forward facing surface on the slide 78, to which locked position the drive member 84 will be moved against the bias of the spring 104 by a force transferred from the slide 78 to the drive member 84 to press the block 64 into the sleeve 20*a*.

The sprocket wheel 86, which provides means for aligning the block 64 of thermoplastic in the passageway 76 for engagement by the teeth of the drive member 84 and for providing sufficient friction to retain the block 64 in the passageway 76 before it is engaged by the drive member 84, is rotatably mounted on a pin 110 extending transverse of the passageway 76 on the side of the passageway opposite the drive member 84 and adjacent the inlet of the passageway 76. The sprocket has a plurality of teeth with axially extending parallel tips spaced to engage betwen the projecting parts of the cylindrical portions 66 and engage the corresponding planar surfaces of the rectangular portions 68 therebetween to orient those contacted planar surfaces parallel to the teeth and axis of the sprocket 86, and to thereby orient the opposite corresponding planar surfaces of the rectangular portions 68 parallel to the teeth 102 on the drive member 84.

To use the dispensing device 60, an operator first connects its power cord 47*a* to a source of electrical power so that its barrel member 14*a* and barrier ring are heated by its heating element. After insuring the slide 78 is in its retracted position, the operator inserts one end of the block 64 of thermoplastic material into the open inlet end of the feeding assembly 62 which orients the block 64 in the passageway 76 by engagement of the teeth on the sprocket wheel 86 along corresponding sides of its rectangular portions 68. He then grabs the handle 26*a* with one hand, engages the thumb of that hand in the recess 82 in the slide 78 and uses his thumb to move the slide 78 so that the teeth 102 on the drive assembly engage between the cylindrical portions 66 on the block 64 to press the block 64 toward the sleeve 20*a* and into the melting chamber in the barrel member 14*a* where the end portion of the block 64 will be made molten by contact with the inner surface of the barrel member 14*a*. As the slide 78 is thus moved from its retracted position toward its advanced position, the force applied through the drive member 84 will allow the drive member 84 to slide longitudinally against the bias of the spring 104, causing the lock pin 108 to engage the transverse slot in the leading surface of the slide 78 and thereby preventing the drive member 84 from moving toward its release position.

After the slide 78 is thus moved fully to its advance position, the operator can manually retract the slide 78 along the periphery of the block 64 by engagement of his thumb against the projection 106 on the drive member 84 which projects into the recess 82 in the slide 78, which engagement will cause the drive member 84 to move relative to the slide 78, the lock pin 108 to move out of the groove in the slide 78, and the drive member 84 to pivot so that the teeth 102 move out of engagement with and along the periphery of the block 64 in the passageway 76; whereupon the operator can again manipulate the slide 78 with his thumb to engage the teeth 102 with a new portion of the block 64 and continue pressing it into the sleeve 20*a* and the melting chamber. Preferably the teeth 102 have leading edges that are disposed at about 89 degrees with respect to the longitudinal direction of the drive member 84 to help the teeth 102 release from the block 64.

Figure 11:
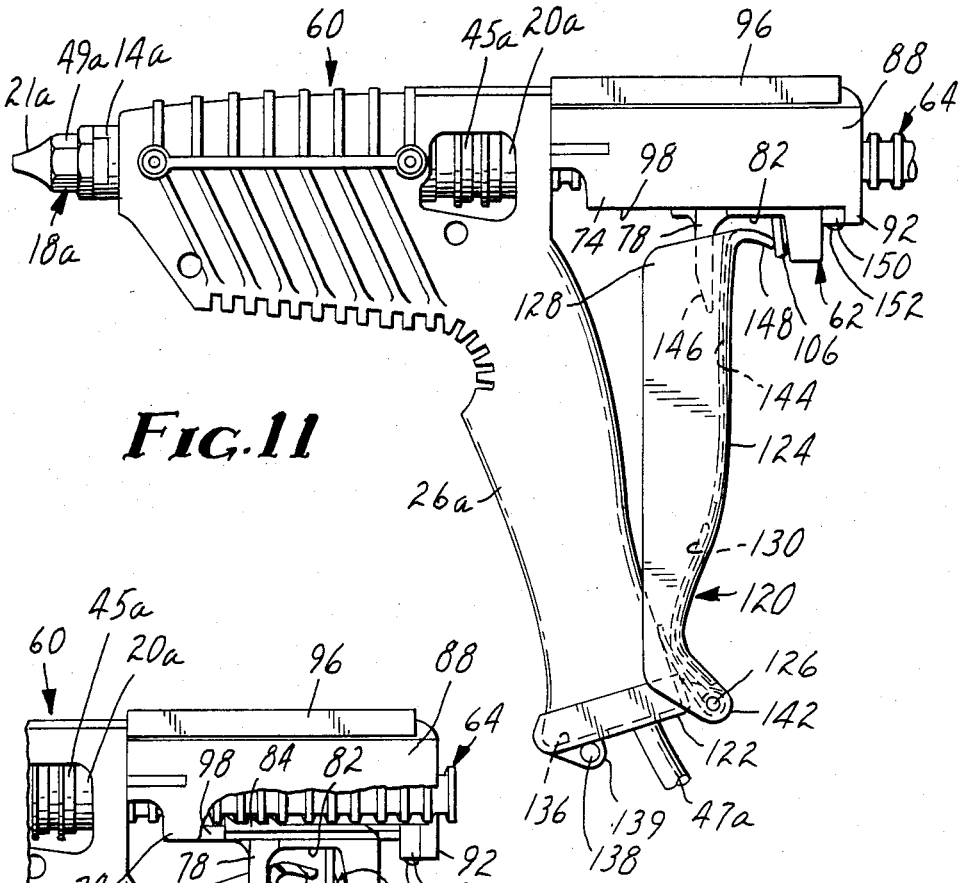
FIG. 11 is a side view of a first embodiment of an attachment according to the present invention shown attached to the dispensing device shown in FIG. 7 with a lever involved in the attachment in a position it assumes when the device is not being used.
Figure 12:
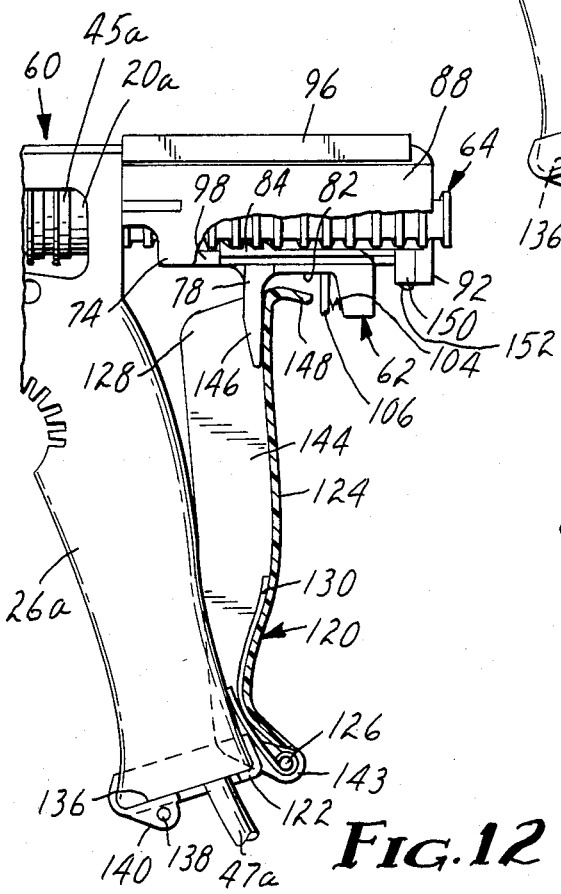
FIG. 12 is a side view of the attachment of FIG. 11 on a fragment of the dispensing device shown in FIG. 7, with the lever in a position it passes through as it is being pressed toward a handle of that device to dispense material from the device.
Figure 13:
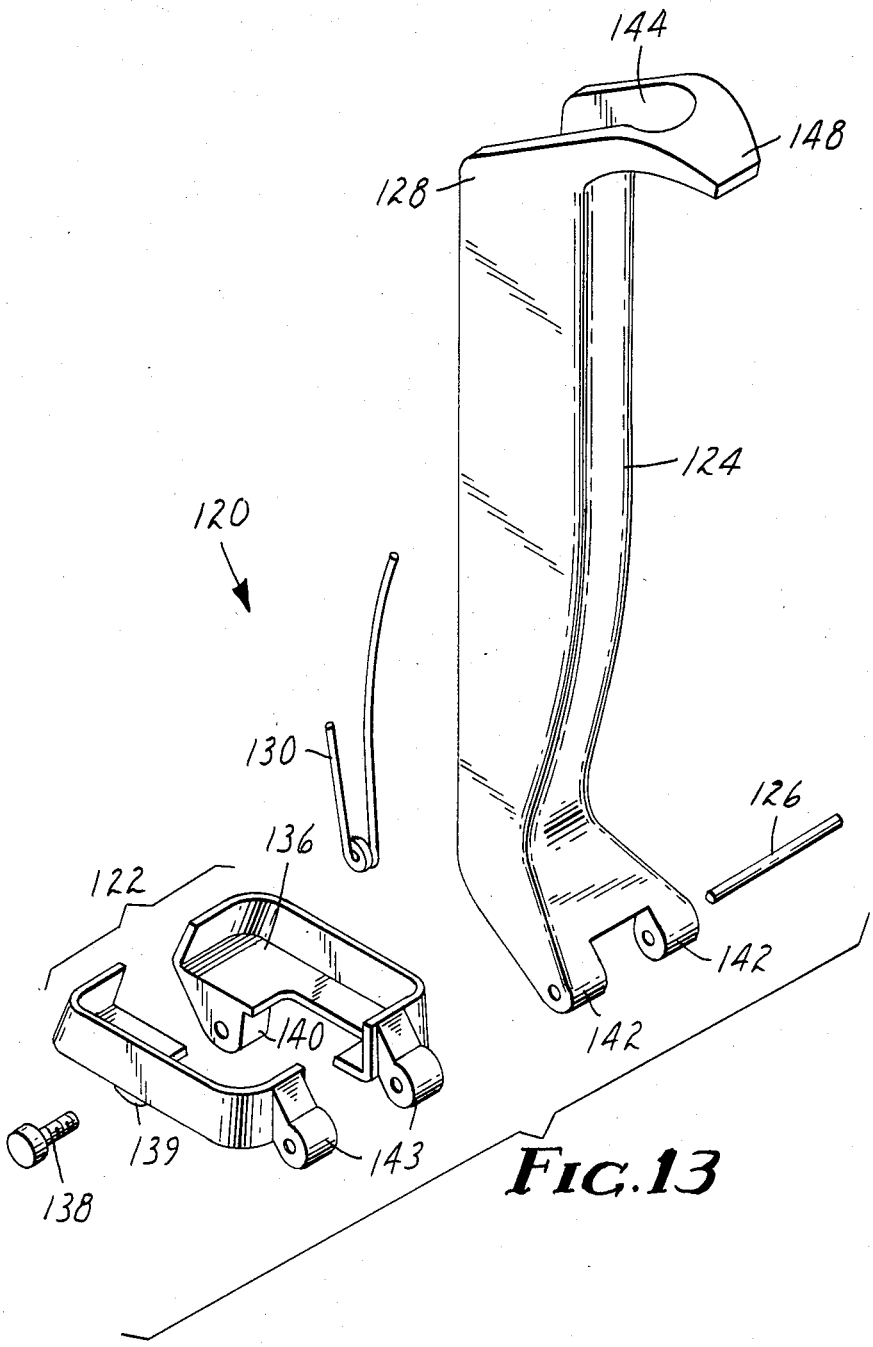
FIG. 13 is an enlarged exploded perspective view of the attachment shown in FIGS. 11 and 12.

Referring now to FIGS. 11, 12, and 13 there is shown a first embodiment of an attachment according to the present invention, generally designated by the reference numeral 120, which attachment 120 is adapted for use on the dispensing device 60.

Generally the attachment assembly 120 comprises a two piece collar 122 adapted for releasable engagement about the distal end of the handle 26*a*; a lever 124 having a lower end pivotably mounted on the collar by a pin 126 and an upper end portion 128 adapted for engagement with pressure surfaces on the slide 78 and drive member 84 of the feed assembly 62; and means in the form of a spring 130 having a coiled central portion wrapped around the pin 126 between two spaced bearing members 143 on the collar 122 through which the pin 136 is journaled; which spring 130 has two ends, one of which is engaged with the handle 26*a* and the other of which is engaged with the lever 124, and biases the lever 124 and thereby the slide 78 toward its retracted position.

The two piece collar 122 has walls defining a socket 136 adapted to closely receive an end portion of the handle 26*a*, which handle 26*a* decreases slightly in size from its end toward its central position so that, once engaged, the collar 122 cannot slip off the end of the handle 26*a*. The collar 122 is releasably held in place on the handle 26*a* by a screw 138 which passes through a lug 139 projecting from the bottom of one half of the collar 122 and threadably engages a lug 140 projecting from the bottom of the other half of the collar 122, and by spaced bearing members 142 projecting from the lower end of the lever 124 which closely flank a pair of similar bearing member 143, one of which projects from each of the collar pieces, through which bearing member 142 and 143 the pin 126 is journaled.

The upper end portion 128 of the lever 124 has a generally C-shaped cross-section defining a cavity 144 adapted to receive a portion of the handle 26*a* when the lever 124 is moved toward the handle 26*a*, and into which cavity 144 a front projecting part 146 defining the recess 82 projects with the central wall of the upper end portion 128 received in the recess 82. The upper end portion 128 also includes a lip 148 projecting away from the cavity 144 which is adapted and positioned to engage the projection 106 on the drive member 84.

A two piece stop member 150 is positioned with the pieces of the stop member 150 on opposite sides of the ledges 98 on which the slide 78 is slidably mounted and on the side of the slide 78 opposite the sleeve 20*a*. The stop member 150 includes a screw 152 that passes through the lower piece of the stop member 150 and threadably engages the upper piece of the stop member 150 so that by tightening the screw 152 the stop member 150 can be clamped on the ledges 98. The stop member 150 can thus be clamped along the ledges 94 in any desired position to establish the retracted position of the slide 78 which may be desirable to adjust that retracted position to the size of the user's hand.

To use the dispensing device 60 with the attachment 120 attached, an operator first connects its power cord 47*a* to a source of electrical power so that its barrel member 14*a* and barrier ring are heated by its heating element, and inserts one end of the block 64 of thermoplastic material into the open inlet end of the feeding assembly 62. He then grabs the handle 26*a* and lever 124 with one hand, and applies squeezing pressure with that hand so that the lever 124 moves the slide 78 by pressure from the lever 124 against the pressure surface on the front projecting part 146 and the teeth 102 on the drive assembly engage between the cylindrical portions 66 on the block 64 to press the block 64 toward the sleeve 20*a* and into the melting chamber. As the slide 78 is thus moved by the lever 124 from its retracted position toward its advanced position, the force applied through the drive member 84 will allow the drive member 84 to slide longitudinally against the bias of the spring 104, causing the lock pin 108 to engage the transverse slot in the leading surface of the slide 78 and thereby preventing the drive member 84 from moving toward its release position.

After the slide 78 is thus moved fully to its advance position, the operator can release his grip on the lever 124 so that the spring 130 retracts the slide 78 along the periphery of the block 64 by engagement of the lip 148 against the projection 106 on the drive member 84, which engagement will cause the drive member 84 to move relative to the slide 78, the lock pin 108 to move out of the groove in the slide 78, and the drive member 84 to pivot so that the teeth 102 move out of engagement with and along the periphery of the block 64 in the passageway 76; whereupon the operator can again move the slide 78 by hand pressure against the lever 124 to engage the teeth 102 with a new portion of the block 64 and continue pressing it into the melting chamber.

Figure 14:
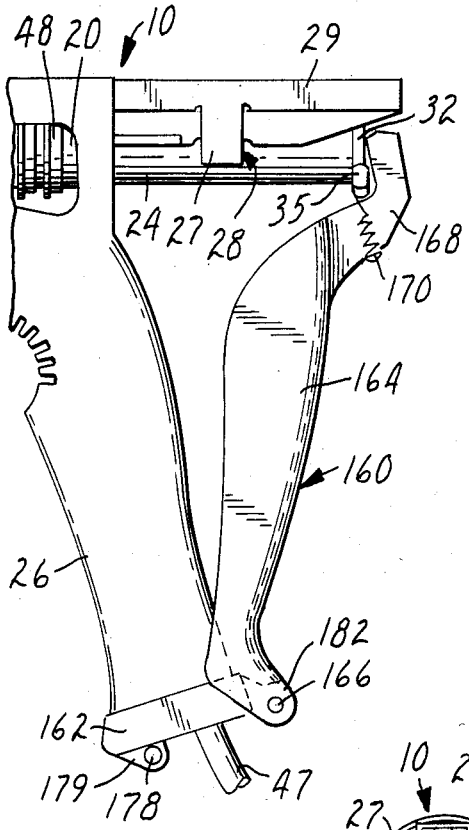
FIGS. 14 and 15 are side views of a second embodiment of an attachment according to the present invention shown attached to fragments of the dispensing device shown in FIG. 1 with a handle included in the attachment shown in two different positions to which it may move.
Figure 15:
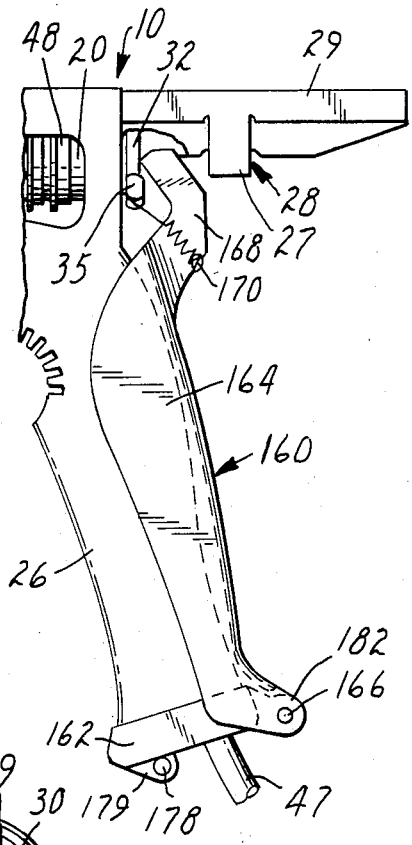
Figure 16:
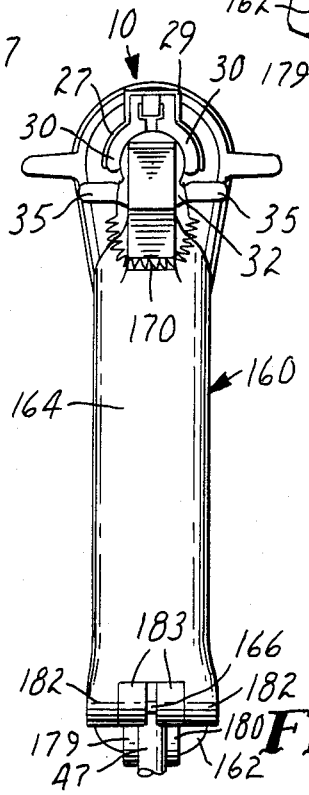
FIG. 16 is an end view of the attachment and dispensing device shown in FIGS. 14 and 15.

Referring now to FIGS. 14, 15, and 16 there is shown a second embodiment of an attachment according to the present invention, generally designated by the reference numeral 160, which attachment 160 is adapted for use on the dispensing device 10.

Generally the attachment assembly 160 comprises a two piece collar 162 adapted for releasable engagement about the distal end of the handle 26; a lever 164 having a lower end pivotably mounted on the collar by a pin 166 and an upper end portion 168 adapted for engagement with a pressure surfaces on the pressure plate or slide 32 on the device 10; and means in the form of a coil spring 170 having ends attached to the wing portions 35 of the pressure plate 32 and a central portion wrapped around the upper end portion 168 of the lever which is generally L-shaped and disposed so that the spring 170 will be extended as the pressure plate 32 is moved from its retracted position (FIG. 14) toward its advanced position (FIG. 15) so that the spring 170 biases the lever 164 and the plate 32 toward the retracted position of the plate 32.

The two piece collar 162 has walls defining a socket adapted to closely receive an end portion of the handle 26 which handle 26 decreases slightly in size from its end toward its central position so that, once engaged, the collar 162 cannot slip off the end of the handle 26. The collar 162 is releasably held in place on the handle 26 by a screw 178 which passes through a lug 179 projecting from the bottom of one half of the collar 162 and threadably engages a lug 180 projecting from the bottom of the other half of the collar 162, and by spaced bearing members 182 pojecting from the lower end of the lever 164 which closely flank the pair of similar bearing members 183, one of which projecting from each of the collar pieces, through which bearing member 182 and 183 the pin 166 is journaled.

A central portion of the lever 164 has a generally C-shaped cross section defining a cavity adapted to receive a portion of the handle 26 when the lever 164 is moved toward the handle 26.

To use the dispensing device 10 with the attachment 160 attached, an operator first connects its power cord 47 to a source of electrical power so that its barrel member 14 and barrier ring are heated by its heating element, and inserts one end of a block 24 of thermoplastic material into the open inlet end of the sleeve 20 and another such block 24 between the gripping parts 30. He then grabs the handle 26 and lever 164 with one hand, and applies squeezing pressure with that hand so that the lever 164 moves the slide pressure plate 32 by pressure from the lever 164 against the pressure surface on the pressure plate 32 and the blocks 24 are pressed toward the melting chamber. The pressure plate 32 is thus moved by the lever 164 from its retracted position toward its advanced position as desired by the operator to dispense molten thermoplastic material.

After the plate 32 is thus moved fully to its advance position, the operator can release his grip on the lever 164 so that the spring 170 returns the pressure plate 32 to its retracted position, whereupon the operator can position another block 24 between the gripping parts 30 and can again move the pressure plate 32 by hand pressure against the lever 164 to pressing the blocks 24 into the melting chamber.

The present invention has now been described with reference to single embodiments thereof. It will be apparent to those skilled in the art that many changes can be made in the embodiment described without departing from the scope of the present invention. Thus the scope of the present invention should not be limited to the structures described in this application, but only by structures described by the language of the claim and their equivalents.

I claim:

1. In combination, a device adapted for dispensing molten, thermoplastic material from a block of the solid thermoplastic material, said device comprising a frame including a handle with a distal end portion positioned so that an operator can grip the handle with the fingers of one hand; a barrel member mounted on said frame and having an internal melting chamber communicating with an outlet opening through a nozzle; a sleeve with a through opening having one end secured to said barrel member with said through opening communicating with the end of said melting chamber opposite said outlet opening, said sleeve being adapted to receive said block of solid thermoplastic material with one end portion of the block in the melting chamber and the block projecting through said sleeve; means for heating said barrel member to melt the end portion of the block therein; and a feeding mechanism at the end of said sleeve opposite said melting chamber comprising wall means fixed to said frame and defining a passageway adapted to guide the solid thermoplastic material block in alignment with the through opening in said sleeve, a slide having pressure surfaces adapted to receive the end portion of an operator's thumb, and being mounted on said frame for movement along a path generally aligned with the melting chamber from a retracted position spaced from said sleeve to an advanced position more closely adjacent the sleeve and back to said retracted position, said slide being adapted for engaging and advancing the block of thermoplastic material toward the melting chamber during movement of said slide from its retracted to its advanced position, and an attachment comprising a collar releasably engaged around the distal end portion of said handle, a lever having a lower end pivotably mounted on said collar and an upper end positioned for engagement with said pressure surfaces, and means for biasing said lever to bias said slide toward said retracted position.

* * * * *